US009932793B2

(12) United States Patent
Lang et al.

(10) Patent No.: US 9,932,793 B2
(45) Date of Patent: Apr. 3, 2018

(54) MILL BLADE TORQUE SUPPORT

(71) Applicant: Halliburton Energy Services, Inc., Houston, TX (US)

(72) Inventors: Loc Phuc Lang, Arlington, TX (US); William Wallace Dancer, Little Elm, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 271 days.

(21) Appl. No.: 14/768,726

(22) PCT Filed: Jul. 28, 2014

(86) PCT No.: PCT/US2014/048473
§ 371 (c)(1),
(2) Date: Aug. 18, 2015

(87) PCT Pub. No.: WO2016/018228
PCT Pub. Date: Feb. 4, 2016

(65) Prior Publication Data

US 2016/0258237 A1 Sep. 8, 2016

(51) Int. Cl.

| | |
|---|---|
| ***E21B 29/06*** | (2006.01) |
| ***E21B 7/06*** | (2006.01) |
| ***E21B 10/26*** | (2006.01) |
| ***E21B 10/43*** | (2006.01) |
| ***E21B 23/01*** | (2006.01) |

(52) U.S. Cl.
CPC ..... *E21B 29/06* (2013.01); *E21B 7/061* (2013.01); *E21B 10/26* (2013.01); *E21B 10/43* (2013.01); *E21B 23/01* (2013.01)

(58) Field of Classification Search
CPC combination set(s) only.
See application file for complete search history.

(56) References Cited

U.S. PATENT DOCUMENTS

| | | | |
|---|---|---|---|
| 5,431,220 | A | 7/1995 | Lennon et al. |
| 5,437,340 | A | 8/1995 | Lee et al. |
| 5,560,440 | A | 10/1996 | Tibbitts |

(Continued)

FOREIGN PATENT DOCUMENTS

| | | | |
|---|---|---|---|
| CN | 2283123 | Y | 6/1998 |
| EP | 1312751 | A2 | 5/2003 |

(Continued)

OTHER PUBLICATIONS

International Search Report and Written Opinion for PCT/US2014/048473 dated Apr. 28, 2015.

(Continued)

*Primary Examiner* — Kyle Armstrong
(74) *Attorney, Agent, or Firm* — McDermott Will & Emery LLP

(57) ABSTRACT

An example whipstock assembly includes a whipstock providing a ramped surface and a longitudinal groove defined in the ramped surface. A lead mill is coupled to the whipstock with a shear bolt and providing one or more blades, and a bearing support is arranged within the longitudinal groove and provides opposing sidewalls that define a slot configured to receive one of the one or more blades and thereby prevent the lead mill from rotating with respect to the whipstock.

20 Claims, 7 Drawing Sheets

(56) References Cited

U.S. PATENT DOCUMENTS

| | | | | |
|---|---|---|---|---|
| 5,727,629 | A * | 3/1998 | Blizzard, Jr. | E21B 7/061 166/117.6 |
| 6,464,002 | B1 * | 10/2002 | Hart | E21B 29/06 166/177.6 |
| 7,980,307 | B2 | 7/2011 | Saylor, III | |
| 8,276,688 | B2 * | 10/2012 | Dietz | E21B 29/00 175/61 |
| 8,469,096 | B2 * | 6/2013 | McGarian | E21B 7/061 166/117.5 |
| 2002/0029889 | A1 | 3/2002 | George et al. | |
| 2002/0073528 | A1 | 6/2002 | Tibbitts | |
| 2008/0185148 | A1 | 8/2008 | Carter et al. | |
| 2009/0133877 | A1 | 5/2009 | Neff | |
| 2010/0012322 | A1 | 1/2010 | McGarian | |
| 2012/0255785 | A1 * | 10/2012 | Gregurek | E21B 7/067 175/57 |

FOREIGN PATENT DOCUMENTS

| | | | |
|---|---|---|---|
| EP | 1878868 | A1 | 1/2008 |
| WO | WO-03071084 | A2 | 8/2003 |
| WO | 2013070935 | A1 | 5/2013 |
| WO | 2016018228 | A1 | 2/2016 |
| WO | 2016018230 | A1 | 2/2016 |

OTHER PUBLICATIONS

International Search Report and Written Opinion for PCT/US2014/048482 dated Apr. 28, 2015.

Extended European Search Report from European Patent Application No. 14899041.9, dated Jan. 5, 2018, 7 pages.

* cited by examiner

MILL BLADE TORQUE SUPPORT

BACKGROUND

The present disclosure relates to multilateral wells in the oil and gas industry and, more particularly, to improved torque supports for mill and whipstock assemblies used to drill multilateral wells.

Hydrocarbons can be produced through relatively complex wellbores traversing a subterranean formation. Some wellbores can be a multilateral wellbore, which includes one or more lateral wellbores that extend from a parent or main wellbore. Multilateral wellbores typically include one or more windows or casing exits defined in the casing that lines the wellbore to allow corresponding lateral wellbores to be formed. More specifically, a casing exit for a multilateral wellbore can be formed by positioning a whipstock in a casing string at a desired location in the main wellbore. The whipstock is often designed to deflect one or more mills laterally (or in an alternative orientation) relative to the casing string. The deflected mill(s) machines away and eventually penetrates part of the casing to form the casing exit through the casing string. Drill bits can be subsequently inserted through the casing exit in order to cut the lateral or secondary wellbore.

Single-trip whipstock designs allow a well operator to run the whipstock and the mills downhole in a single run, which greatly reduces the time and expense of completing a multilateral wellbore. Some conventional single-trip whipstock designs anchor a lead mill to the whipstock using a combination of a shear bolt and a torque lug. The shear bolt is designed to shear upon assuming a particular set down weight when a well operator desires to free the mills from the whipstock. The shear bolt is typically not designed to shear in torque. The torque lug, on the other hand, provides rotational torque support that helps prevent the shear bolt from fatiguing prematurely or otherwise shearing in torque as the whipstock is run into the main wellbore. The lead mill provides a slot that the torque lug fits into to prevent the lead mill from rotating about its central axis. In this configuration, however, the lead mill may nonetheless be able to pivot on the torque lug and one of its blades contacting the ramped surface of the whipstock, which creates a lift force that puts the shear bolt in tensile and torsional stress. This can fatigue the shear bolt and causes it to shear prematurely, thereby prematurely freeing the lead mill from whipstock.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to multilateral wells in the oil and gas industry and, more particularly, to improved torque supports for mill and whipstock assemblies used to drill multilateral wells.

The embodiments described herein provide exemplary whipstock assemblies that allow more torque to be transmitted from a lead mill to a whipstock without risking failure of a shear bolt used to couple the lead mill to the whipstock. As a result, the whipstock may be able to assume rotational as well as axial thrust loads without risking premature failure of the shear bolt and premature detachment of the lead mill within a wellbore. In one embodiment, for example, an exemplary whipstock assembly may include a bearing support arranged within a longitudinal groove defined in the whipstock. The bearing support provides a slot to receive a blade of the lead mill and thereby prevent the lead mill from rotating with respect to the whipstock and potentially prematurely shearing the shear bolt. Moreover, the bearing support may prevent the lead mill from engaging the longitudinal groove during milling operations and may be made of an easily millable material, such as aluminum, such that the lead mill is able to mill through the bearing support as it advances up the whipstock.

In a second embodiment, another exemplary whipstock assembly may include a torque key movably situated within a slot defined in the lead mill. The torque key is movable between an extended position and a retracted position. In the extended position, the torque key is partially positioned within the slot and the longitudinal groove defined in the whipstock, and thereby able to prevent the lead mill from rotating with respect to the whipstock. In the retracted position, the torque key is retracted out of the longitudinal groove and wholly situated in the slot. In some cases, the torque key may be spring-loaded to move to the retracted configuration. With the torque key retracted into the slot, the lead mill is able to operate without being obstructed by the torque key.

Figure 1:
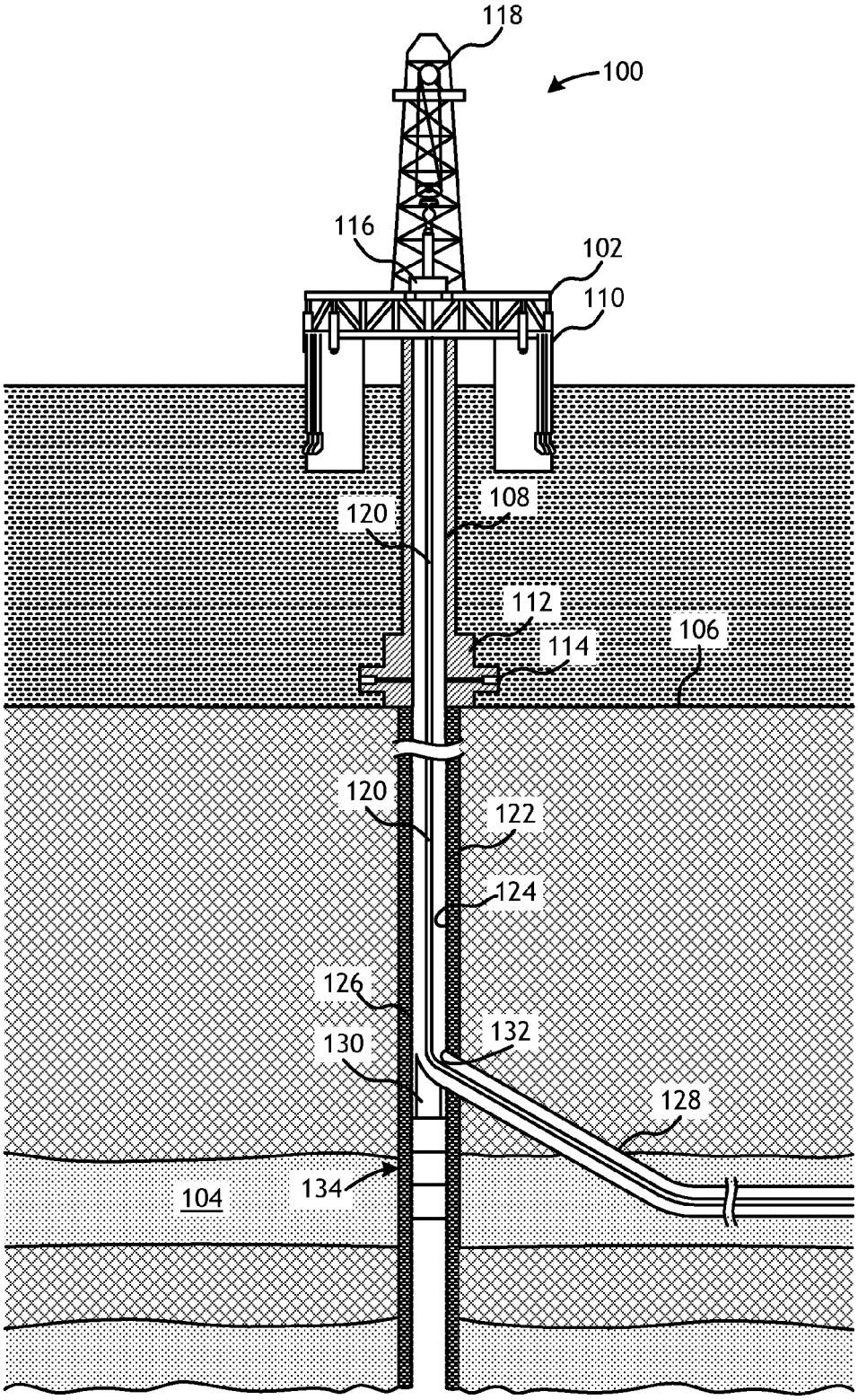
FIG. 1 is a schematic diagram of a well system that may employ the principles of the present disclosure.

Referring to FIG. 1, illustrated is an exemplary well system 100 that may employ the principles of the present disclosure, according to one or more embodiments. As illustrated, the well system 100 may include an offshore oil and gas platform 102 centered over a submerged subterranean formation 104 located below the sea floor 106. While the well system 100 is described in conjunction with the offshore oil and gas platform 102, it will be appreciated that the embodiments described herein are equally well suited for use with other types of oil and gas rigs, such as land-based rigs or drilling rigs located at any other geographical site. The platform 102 may be a semi-submersible drilling rig, and a subsea conduit 108 may extend from the deck 110 of the platform 102 to a wellhead installation 112 that includes one or more blowout preventers 114. The platform 102 has a hoisting apparatus 116 and a derrick 118 for raising and lowering pipe strings, such as a drill string 120, within the subsea conduit 108.

As depicted, a main wellbore 122 has been drilled through the various earth strata, including the formation 104. The terms "parent" and "main" wellbore are used herein to designate a wellbore from which another wellbore is drilled. It is to be noted, however, that a parent or main wellbore is not required to extend directly to the earth's surface, but could instead be a branch of another wellbore. A string of casing 124 is at least partially cemented within the main wellbore 122. The term "casing" is used herein to designate a tubular member or conduit used to line a wellbore. The casing 124 may actually be of the type known to those skilled in the art as "liner" and may be segmented or continuous, such as coiled tubing.

In some embodiments, a casing joint 126 may be interconnected between elongate upper and lower lengths or sections of the casing 124 and positioned at a desired location within the wellbore 122 where a branch or lateral wellbore 128 is to be drilled. The terms "branch" and "lateral" wellbore are used herein to designate a wellbore that is drilled outwardly from an intersection with another wellbore, such as a parent or main wellbore. Moreover, a branch or lateral wellbore may have another branch or lateral wellbore drilled outwardly therefrom at some point. A whipstock assembly 130 may be positioned within the casing 124 and secured and otherwise anchored therein at an anchor assembly 134 arranged or near the casing joint 126. The whipstock assembly 130 may operate to deflect one or more cutting tools (i.e., mills) into the inner wall of the casing joint 126 such that a casing exit 132 can be formed therethrough at a desired circumferential location. The casing exit 132 provides a "window" in the casing joint 126 through which one or more other cutting tools (i.e., drill bits) may be inserted to drill and otherwise form the lateral wellbore 128.

It will be appreciated by those skilled in the art that even though FIG. 1 depicts a vertical section of the main wellbore 122, the embodiments described in the present disclosure are equally applicable for use in wellbores having other directional configurations including horizontal wellbores, deviated wellbores, or slanted wellbores. Moreover, use of directional terms such as above, below, upper, lower, upward, downward, uphole, downhole, and the like are used in relation to the illustrative embodiments as they are depicted in the figures, the uphole direction being toward the surface of the well and the downhole direction being toward the toe of the well.

Figure 2A:
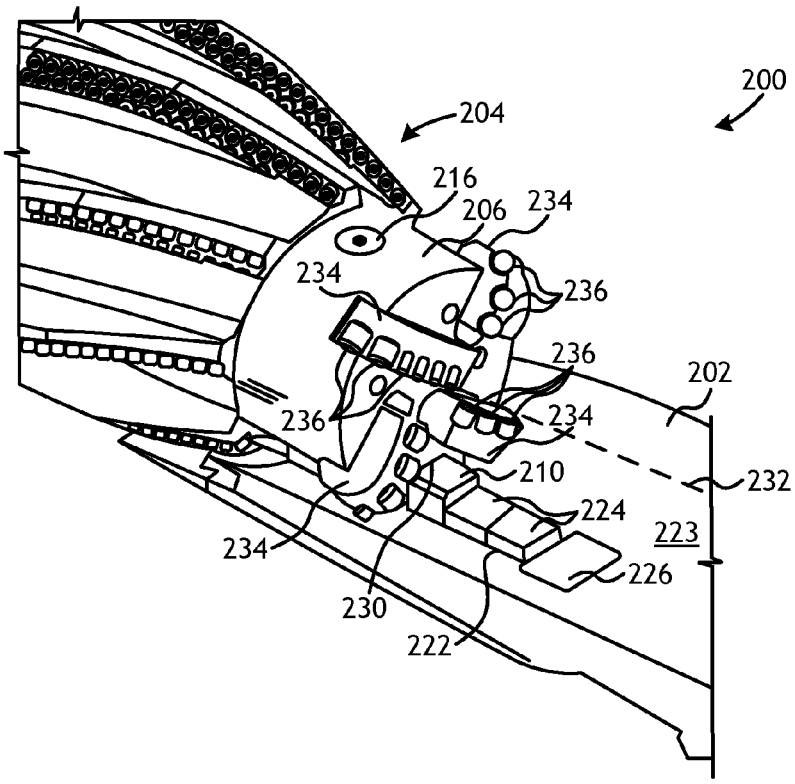
FIGS. 2A and 2B are isometric and cross-sectional side views, respectively, of an exemplary whipstock assembly.
Figure 2B:
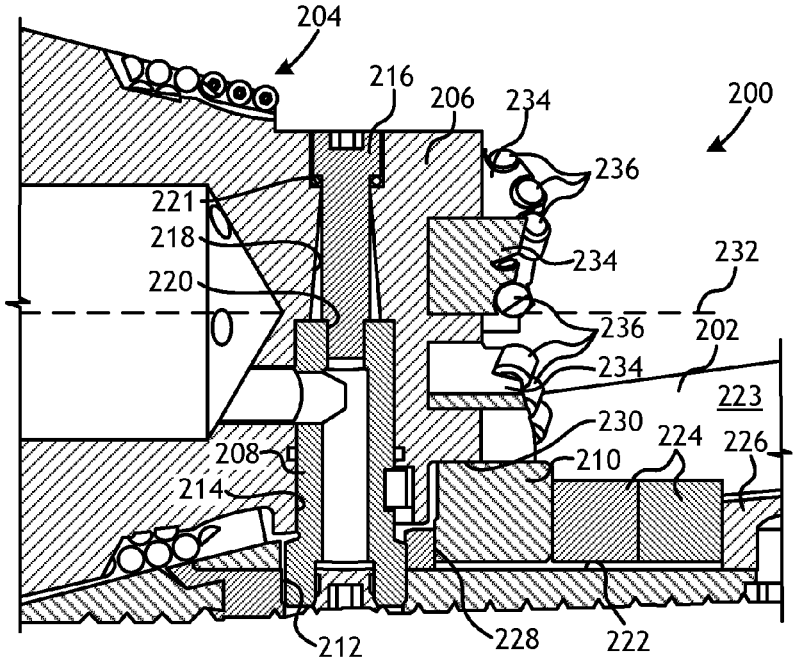

Referring now to FIGS. 2A and 2B, with continued reference to FIG. 1, illustrated is are views of an exemplary whipstock assembly 200. More particularly, FIG. 2A depicts an isometric view of the whipstock assembly 200, and FIG. 2B depicts a cross-sectional side view of the whipstock assembly 200. The whipstock assembly 200 may be similar to or the same as the whipstock assembly 130 of FIG. 1 and, therefore, may be able to be lowered into the wellbore 122 and secured therein to help facilitate the creation of the casing exit 132 in the casing 124.

As illustrated, the whipstock assembly 200 may include a deflector or whipstock 202 and one or more mills 204. The mills 204 may include a lead mill 206 configured to be coupled or otherwise secured to the whipstock 202. More particularly, the lead mill 206 may be secured to the whipstock 202 using at least a shear bolt 208 (FIG. 2B) and a torque lug 210. The shear bolt 208 may be configured to shear or otherwise fail upon assuming a predetermined axial load provided to the lead mill 206, and the torque lug 210 may provide the lead mill 206 with rotational torque resistance that helps prevent the shear bolt 208 from fatiguing prematurely in torque as the whipstock assembly 200 is run downhole.

As best seen in FIG. 2B, in some embodiments, the shear bolt 208 may extend through and be threaded into a threaded aperture 212 defined through the underside of the whipstock 202. The shear bolt 208 may further extend into a shear bolt aperture 214 defined in the lead mill 206, where the threaded aperture 212 and the shear bolt aperture 214 are configured to axially align to cooperatively receive the shear bolt 208 therein. The shear bolt 208 may be secured within the lead mill 206 with a retaining bolt 216 that is extendable into a retaining bolt aperture 218 defined in the lead mill 206. As illustrated, the retaining bolt aperture 218 may be aligned with and otherwise form a contiguous portion of the shear bolt aperture 214. The retaining bolt 216 may be threadably secured to the shear bolt 208 at a threaded cavity 220 defined in the end of the shear bolt 208, and the head of the retaining bolt 216 may rest on a shoulder 221 defined in the retaining bolt aperture 218. With the shear bolt 208 threadably secured to the whipstock 202 and the retaining bolt 216 threadably secured to the shear bolt 208 at the threaded cavity 220, the lead mill 206 (and any other mills 204) may thereby be securely coupled to the whipstock 202.

The torque lug 210 may be a solid metal block made of, for example, aluminum or another easily millable material. The torque lug 210 may be arranged within a longitudinal groove 222 defined in a ramped surface 223 of the whipstock 202. The torque lug 210 may be arranged within the longitudinal groove 222 along with one or more bumper members 224 (two shown) and a whipstock plate 226. More particularly, the bumper members 224 may be made of a pliable or flexible material, such as rubber or an elastomer, and the whipstock plate 226 may be configured to bias the bumper members 224 against the torque lug 210 so that the torque lug 210 is correspondingly urged against an axial end wall 228 of the longitudinal groove 222. The torque lug 210 may further be configured to be inserted or otherwise extended into a slot 230 defined in the lead mill 206. As arranged within the slot 230, the torque lug 210 may be configured to prevent the lead mill 206 (or the mills 204 generally) from rotating about a central axis 232.

In exemplary operation, and with continued reference to FIG. 1, the whipstock assembly 200 may be lowered downhole within the wellbore 122 with the mills 204 secured to the whipstock 202 as generally described above. Upon reaching a location in the wellbore 122 where the casing exit 132 is to be formed, the whipstock assembly 200 may be latched into the anchor assembly 134 (FIG. 1) previously arranged within the wellbore 122. Latching in the whipstock assembly 200 may include extending the whipstock assembly into the anchor assembly 134 and then rotating the whipstock assembly 200 as the whipstock assembly 200 is pulled back uphole or toward the surface. Once the whipstock assembly 200 is properly latched into the anchor assembly 134, weight is set down on the whipstock assembly 200 from a surface location. Placing weight on the whipstock assembly 200 may provide an axial load to the lead mill 206, which may transfer a predetermined axial load to the shear bolt 208. Upon assuming the predetermined axial load, the shear bolt 208 may shear or otherwise fail, and thereby free the mills 204 from axial engagement with the whipstock 202.

With the weight still applied on the lead mill 206, the torque lug 210 may be forced against the bumper members 224 in the downhole direction (i.e., to the right in FIG. 2B), and the bumper members 224 may provide an opposing biasing resistance to the torque lug 210 in the uphole direction (i.e., to the left in FIG. 2B). The mills 204 (including the lead mill 206) may then be pulled back in the uphole direction a short distance, and the bumper members 224 may then urge the torque lug 210 back against the axial end wall 228. Once free from the whipstock 202, the mills 204 may then be rotated about the central axis 232 and simultaneously advanced in the downhole direction. As the mills 204 advance downhole, they ride up the ramped surface 223 of the whipstock 202 until engaging and milling the inner wall of the casing 124 to form the casing exit 132.

As illustrated, the lead mill 206 may include one or more blades 234 (four shown) and a plurality of cutters 236 secured to each blade 234. In the above-described configuration, the lead mill 206 may pivot on the torque lug 210 upon assuming a torsional load. Such torsional loads may be generated while latching in the whipstock assembly 200, as described above, or while lowering the whipstock assembly 200 downhole through portions of the wellbore 122 (FIG. 1) that require the whipstock assembly 200 to be rotated. Torsional loads applied to the whipstock assembly 200 may result in the lead mill 206 pivoting on the torque lug 210 and one of the blades 234 that contacts the ramped surface 223 of the whipstock 202. As a result, a lift force may be generated that places tensile and/or torsional loading on the shear bolt 208, which, if not properly mitigated, could fatigue the shear bolt 208 and otherwise causes it to fail prematurely.

According to the present disclosure, embodiments of improved whipstock assemblies may allow more torque to be transmitted from the lead mill 206 to the whipstock 202 without shearing or otherwise compromising the structural integrity of the shear bolt 208. As described herein, such improved whipstock assemblies may be configured to lock the lead mill 206 to the whipstock 202 in torque, and thereby prevent the shear bolt 206 from fatigue or premature shearing in torque. Moreover, the presently described embodiments allow for an easy and quick assembly of the lead mill 206 to the whipstock 202 in a vertical direction.

Figure 3A:
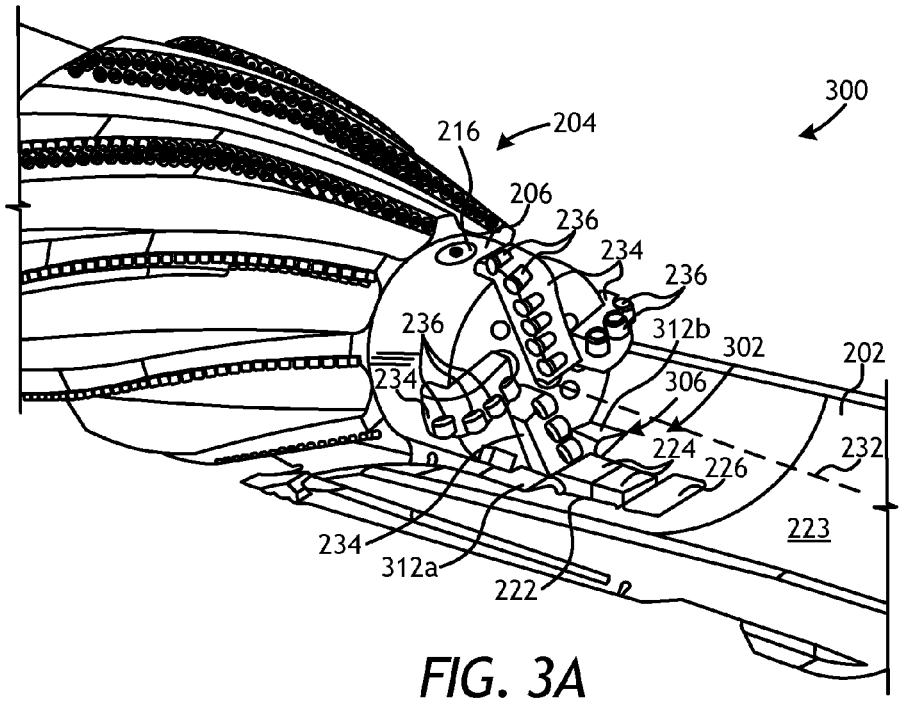
FIGS. 3A-3C are views of an exemplary whipstock assembly.
Figure 3B:
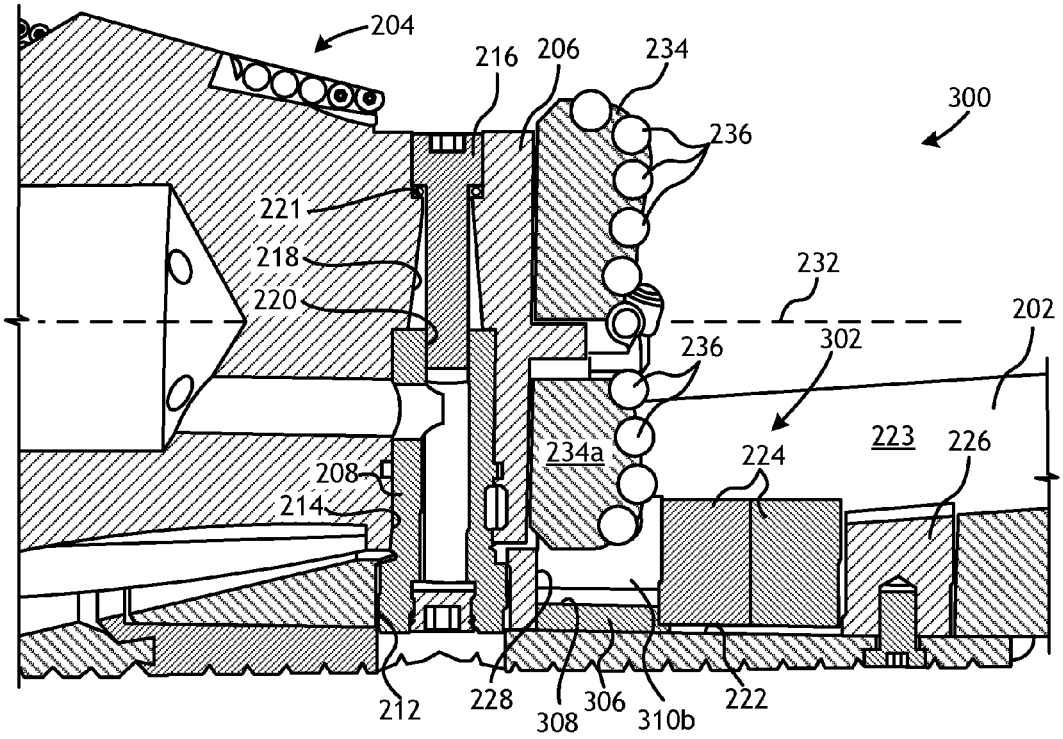
Figure 3C:
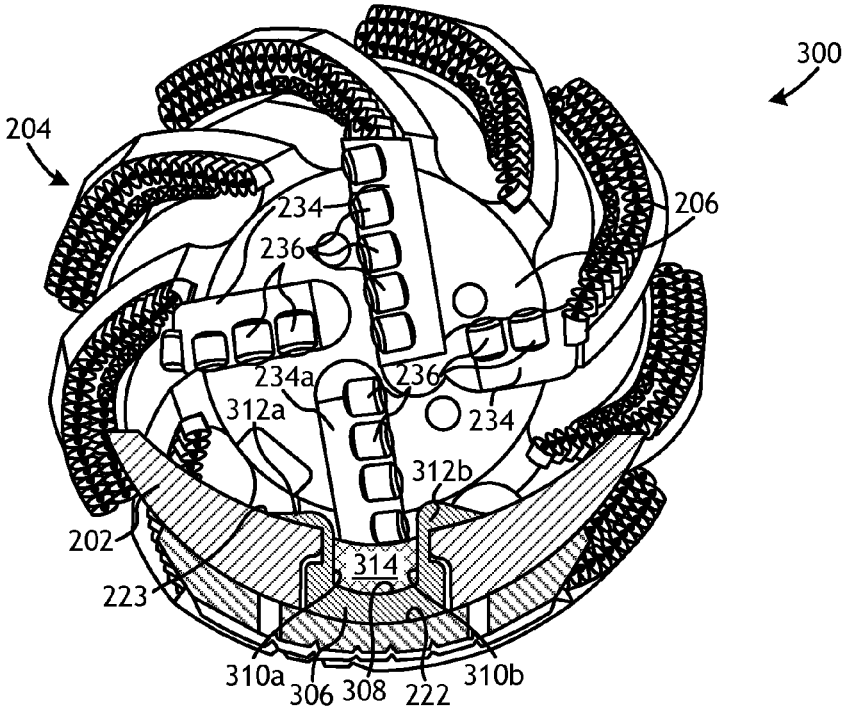

Referring now to FIGS. 3A-3C, with continued reference to FIGS. 2A-2B, illustrated are various views of an exemplary whipstock assembly 300, according to one or more embodiments of the present disclosure. More particularly, FIG. 3A depicts an isometric view of the whipstock assembly 300, FIG. 3B depicts a cross-sectional side view of the whipstock assembly 300, and FIG. 3C depicts a cross-sectional end view of the whipstock assembly 300. The whipstock assembly 300 may be similar in some respects to the whipstock assembly 200 of FIG. 2 and therefore may be best understood with reference thereto, where like numerals indicate like elements or components not described again in detail. Similar to the whipstock assembly 200 of FIG. 2, for example, the whipstock assembly 300 may include the whipstock 202, the mills 204 (including the lead mill 206), the shear bolt 208 used to secure the lead mill 206 to the whipstock 202, and the retaining bolt 216 used to secure the shear bolt 208 to the lead mill 206. Moreover, the lead mill 206 may include the blades 234 (four shown) and the plurality of cutters 236 secured to each blade 234, as generally described above. As will be appreciated, more or less than four blades 234 may be provided on the lead mill 206, without departing from the scope of the disclosure.

Unlike the whipstock assembly 200 of FIG. 2, however, the torque lug 210 (FIG. 2) may be omitted from the whipstock assembly 300. In its place to help stabilize the lead mill 206 in torque as coupled to the whipstock 202, the whipstock assembly 300 may further include a torque bearing assembly 302. The torque bearing assembly 302 may be generally arranged within the longitudinal groove 222 defined in the ramped surface 223 of the whipstock 202, and may include the one or more bumper members 224 (two shown), the whipstock plate 226, and a bearing support 306. The bearing support 306 may be secured within the longitudinal groove 222 using the bumper members 224 and the whipstock plate 226. More particularly, the bumper members 224 may be configured to biasingly engage the end of the bearing support 306 and thereby urge the bearing support 306 against the axial end wall 228 of the longitudinal groove 222.

As best seen in FIG. 3C, the bearing support 306 may be a generally U-shaped structure that defines a slot 308 having opposing sidewalls 310*a* and 310*b*. The sidewalls 310*a,b* may extend upwardly out of the longitudinal groove 222 and transition into opposing side extensions 312*a* and 312*b* that rest on the ramped surface 223 of the whipstock 202 and otherwise extend a short distance in opposing directions away from the slot 308. The bearing support 306 may be made of an easily millable material such as, but not limited to, aluminum, bronze, cast or mild steel, free machining steel, fiberglass, or the like.

According to the present embodiment, one of the blades 234 (shown and labeled as blade 234*a*) of the lead mill 206 may be extended at least partially into the slot 308 to prevent the lead mill 206 (or the mills 204 generally) from rotating about the central axis 232 with respect to the whipstock 202. More particularly, when torque is applied to the lead mill 206, the blade 234*a* may drop further down into the slot 308, which prevents it from pivoting on the ramped surface 223 of the whipstock 202. As more torque is applied, the blade 234*a* may be forced into engagement with one or both of the sidewalls 310*a,b*, which may catch the blade 234*a* and thereby resist any further rotation. Upon engaging the sidewall(s) 310*a,b*, the torque load assumed by the lead mill 206 may then be transferred to the whipstock 202 for rotation as intended.

In some embodiments, engaging the blade 234*a* on the sidewalls 310*a,b* may effectively bind the blade 234*a* within the slot 308, and thereby prevent its removal therefrom by pivoting movement or motion. In other words, the blade 234*a* becomes trapped in the slot 308, which prevents the blade 234*a* from disengaging from the whipstock 202 before the shear bolt 208 is sheared. As opposed to the torque lug 210 of FIGS. 2A-2B, which would provide a point loading pivot on the lead mill 206, the slot 308 provides the blade 234*a* with an increased surface area to make contact with, which allows increased surface loading to be assumed by the bearing support 306 in helping prevent the lead mill 206 from pivoting out of engagement with the whipstock 202.

In at least one embodiment, a slot bumper 314 (FIG. 3C) may be arranged within the slot 308 and may be made of a similar material as the bumper members 224. The slot bumper 314 may be configured to vertically support the blade 234*a* as it is extended into the slot 308 and otherwise prevent the blade 234*a* from deflecting too far into slot 308, which could result in too much potential movement in the lead mill 206. The slot bumper 314 may prove especially advantageous when the lead mill 206 assumes a torsional load that forces the blade 234*a* downward into the slot 308. In some embodiments, the blade 234*a* may be in vertical contact with the slot bumper 314 when the lead mill 206 is secured to the whipstock 202. In other embodiments, the blade 234*a* may contact the slot bumper 314 only when the lead mill 206 assumes a torsional load that forces the blade 234*a* downward into the slot 308.

With continued reference to FIGS. 3A-3C and reference again to FIG. 1, exemplary operation of the whipstock assembly 300 is now provided. The whipstock assembly 300 may be similar to or the same as the whipstock assembly 130 of FIG. 1 and, therefore, may be able to be lowered into the wellbore 122 and secured therein to help facilitate the creation of the casing exit 132 in the casing 124. Accordingly, the whipstock assembly 300 may be lowered downhole within the wellbore 122 with the mills 204 secured to the whipstock 202. Upon reaching a location in the wellbore 122 where the casing exit 132 is to be formed, the whipstock assembly 300 may be latched into an anchor assembly 134 previously arranged within the wellbore 122, as generally described above.

As the whipstock assembly 300 is conveyed downhole and subsequently latched into the anchor assembly 134, the blade 234*a* of the lead mill 206 may be extended into the slot 308 of the bearing support 306. As a result, any torsional loads generated while latching in the whipstock assembly 300 or while rotating the whipstock assembly 300 to bypass tight portions of the wellbore 122 (FIG. 1) may be assumed by the bearing support 306 through contact between the blade 234*a* and the sidewalls 310*a,b* of the bearing support 306. Without urging the lead mill 206 to pivot and thereby place torsional stress on the shear bolt 208, the bearing support 306 may transfer the torsional load to the whipstock 202 for intended rotation thereof. Accordingly, the whipstock assembly 300 may allow more torque to be transmitted from the lead mill 206 to the whipstock 202 without shearing or otherwise compromising the structural integrity of the shear bolt 208.

Once the whipstock assembly 300 is properly latched into the anchor assembly 134, weight is set down on the whipstock assembly 300 from a surface location, which provides an axial load to the lead mill 206 and transfers a predetermined axial load to the shear bolt 208. Upon assuming the predetermined axial load, the shear bolt 208 may shear or otherwise fail, and thereby free the mills 204 from engagement with the whipstock 202.

With the shear bolt 208 severed and the weight still applied on the lead mill 206 from the surface location, the bearing support 306 may be forced against the bumper members 224 in the downhole direction (i.e., to the right in FIG. 3B). In response, the bumper members 224 may provide an opposing biasing resistance against the bearing support 306 in the uphole direction (i.e., to the left in FIG. 3B). The mills 204 (including the lead mill 206) may then be pulled back in the uphole direction a short distance, and the pliant bumper members 224 may then urge the bearing support 206 back against the axial end wall 228. Once free from the whipstock 202, the mills 204 may then be rotated about the central axis 232 and simultaneously advanced in the downhole direction. As the mills 204 advance downhole, they ride up the ramped surface 223 of the whipstock 202 until engaging and milling the inner wall of the casing 124 to form the casing exit 132.

As will be appreciated, allowing the bumper members 224 to move the bearing support 206 back against the axial end wall 228 may prove advantageous in preventing the lead mill 206 from milling into the side walls of the longitudinal groove 222, which could result in damage to the blades 234 and/or the cutters 236. Rather, with the bearing support 206 moved back against the axial end wall 228, the lead mill 206 may instead engage and mill the side extensions 312*a,b* of the bearing support 206. Whereas the whipstock 202 and the side walls of the longitudinal groove 222 may be made of steel or another hard and durable material, the side extensions 312*a,b* of the bearing support 206 are made of a more easily millable material, such as aluminum. As a result, the lead mill 206 may be able to mill away portions of the bearing support 306 instead of the longitudinal groove 222 as the mills 204 advance up the ramped surface 223 of the whipstock 202.

Figure 4A:
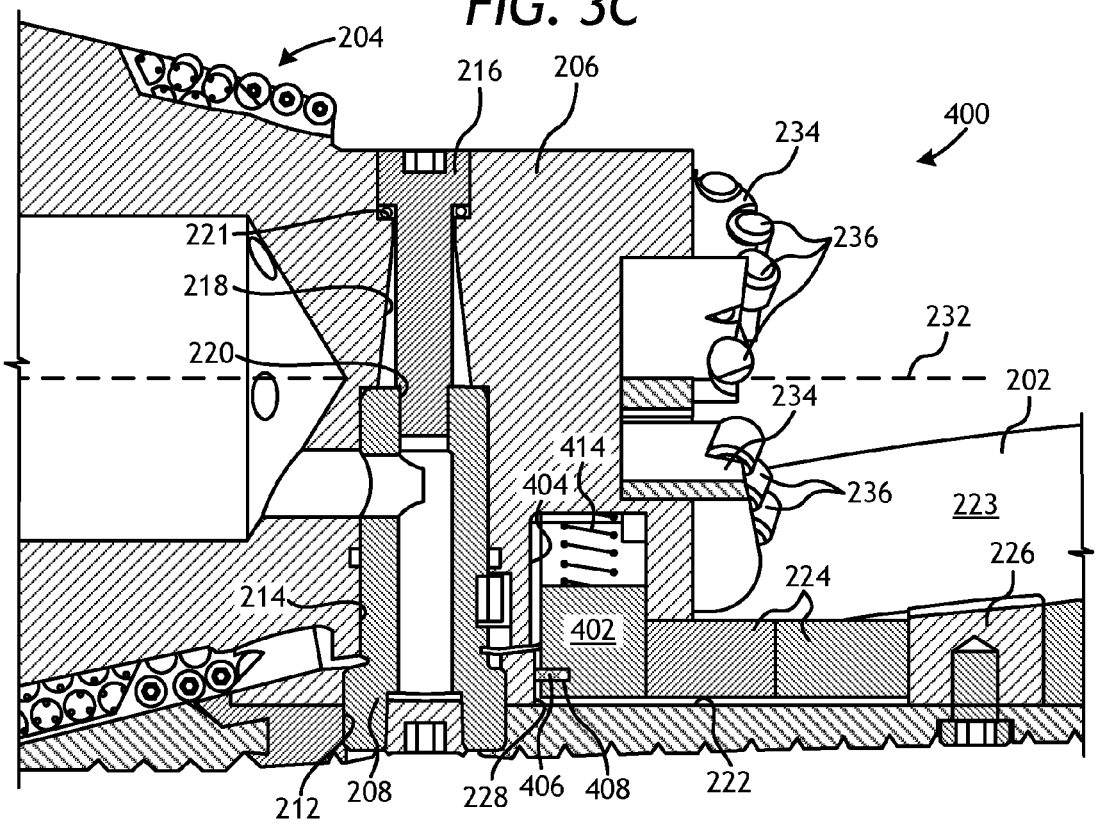
FIGS. 4A-4C are various views of another exemplary whipstock assembly.
Figure 4B:
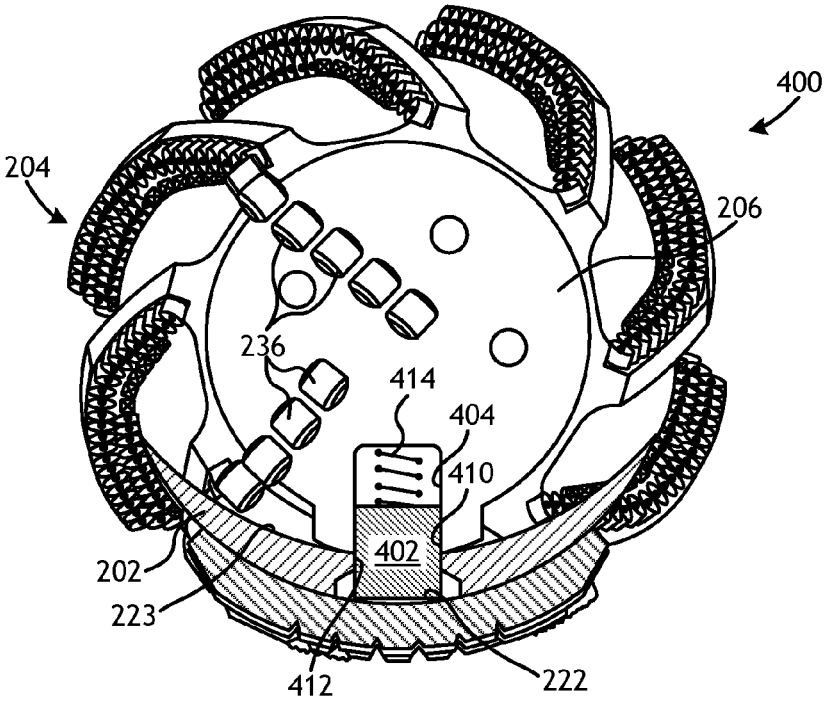
Figure 4C:
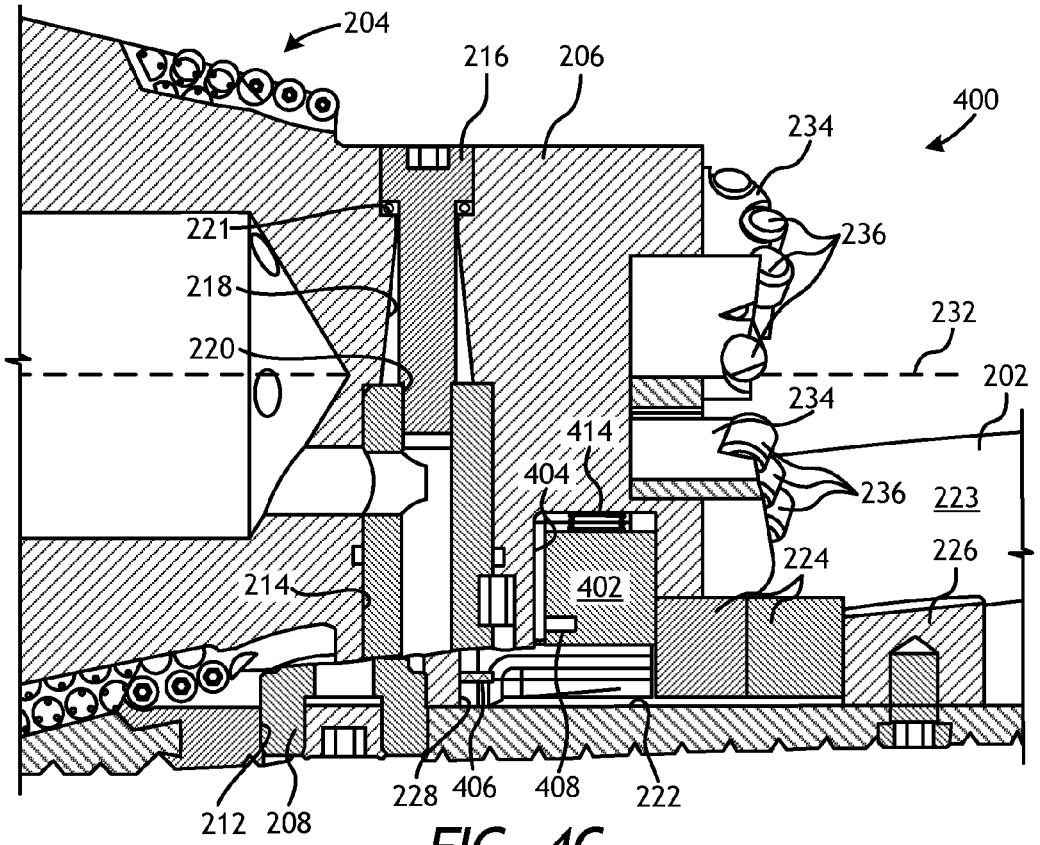

Referring now to FIGS. 4A-4C, illustrated are views of another exemplary whipstock assembly 400, according to one or more additional embodiments of the present disclosure. More particularly, FIG. 4A depicts a cross-sectional side view of the whipstock assembly 400 in an extended configuration, FIG. 4B depicts a cross-sectional end view of the whipstock assembly 400 in the extended configuration, and FIG. 4C depicts a cross-sectional side view of the whipstock assembly 400 in a retracted configuration. The whipstock assembly 400 may be similar in some respects to the whipstock assembly 200 of FIG. 2 and therefore may be best understood with reference thereto, where like numerals indicate like elements or components not described again in detail. Similar to the whipstock assembly 200 of FIG. 2, for example, the whipstock assembly 400 may include the whipstock 202, the mills 204 (including the lead mill 206), the shear bolt 208 used to secure the lead mill 206 to the whipstock 202, and the retaining bolt 216 used to secure the shear bolt 208 to the lead mill 206. Moreover, the lead mill 206 may include the blades 234 and the plurality of cutters 236 secured to each blade 234, as generally described above.

Unlike the whipstock assembly 200 of FIG. 2, however, the whipstock assembly 400 may include a torque key 402 used to help stabilize the lead mill 206 in torque as coupled to the whipstock 202. The torque key 402 may be movably arranged within a slot 404 defined in the lead mill 206. More particularly, the torque key 402 may be movable between a first or extended position, as shown in FIGS. 4A and 4B, to a second or retracted position, as shown in FIG. 4C. In the extended position, the torque key 402 may be partially positioned within both the slot 404 and the longitudinal groove 222 defined in the ramped surface 223 of the whipstock 202. One or more retaining pins 406 (one shown) may extend axially from the axial end wall 228 of the longitudinal groove 222 and may be configured to secure the torque key 402 in the extended position and otherwise as extended into the longitudinal groove 222. In some embodiments, as illustrated, the retaining pin 406 may be configured to be received within a corresponding pin aperture 408 defined in the torque key 402. In at least one embodiment, the retaining pin 406 may extend from the axial end wall 228 of the longitudinal groove 222, but could alternatively extend from any portion of the whipstock 202, without departing from the scope of the disclosure.

As best seen in FIG. 4A, the bumper members 224 may biasingly engage and otherwise urge the torque key 402 against the axial end wall 228 of the longitudinal groove 222 when the torque key 402 is in the extended position. As arranged within both the slot 404 and the longitudinal groove 222, the torque key 402 may be configured to prevent the lead mill 206 (or the mills 204 generally) from rotating about the central axis 232. More particularly, and as best seen in FIG. 4B, when a torsional load is applied to the lead mill 206, the torque key 402 may assume the torsional load via slot sidewalls 410 provided by the slot 404 and transfer the torsional load to groove sidewalls 412 provided by the longitudinal groove 222. Transferring the torsional load to the groove sidewalls 412 of the longitudinal groove 222 may effectively transfer the torsional load to the whipstock 202 for rotation. As will be appreciated, embedding the torque key 402 into the lead mill 206 allows the torque key 402 to operate as soon as a torque load is applied to the lead mill 206, thus minimizing the torsional load on the shear bolt 208.

With continued reference to FIGS. 4A-4C, and reference again to FIG. 1, exemplary operation of the whipstock assembly 400 is now provided. The whipstock assembly 400 may be similar to or the same as the whipstock assembly 130 of FIG. 1 and, therefore, may be able to be lowered into the wellbore 122 and secured therein to help facilitate the creation of the casing exit 132 in the casing 124. Accordingly, the whipstock assembly 400 may be lowered downhole within the wellbore 122 with the mills 204 secured to the whipstock 202, and upon reaching a location in the wellbore 122 where the casing exit 132 is to be formed, the whipstock assembly 400 may be latched into the anchor assembly 134, as generally described above.

As the whipstock assembly 400 is conveyed downhole and latched into the anchor assembly 134, the whipstock 400 assembly may be in the extended configuration where the torque key 402 is positioned in the extended position and held in place within both the slot 404 and the longitudinal groove 222 with the retaining pin(s) 406. As a result, any torsional loads generated while latching in the whipstock assembly 400, or while rotating the whipstock assembly 400 to bypass tight portions of the wellbore 122 (FIG. 1), may be assumed by the torque key 402 through contact between the torque key 402 and the slot and groove sidewalls 410, 412. Without urging the lead mill 206 to pivot and thereby place torsional stress on the shear bolt 208, the torque key 402 may instead transfer the torsional load to the whipstock 202 for intended rotation thereof. Accordingly, the whipstock assembly 400 may allow more torque to be transmitted from the lead mill 206 to the whipstock 202 without shearing or otherwise compromising the structural integrity of the shear bolt 208.

Once the whipstock assembly 400 is properly latched into the anchor assembly 134, weight may be set down on the whipstock assembly 400 from a surface location, which provides an axial load to the lead mill 206 and transfers a predetermined axial load to the shear bolt 208. Upon assuming the predetermined axial load, the shear bolt 208 may shear or otherwise fail, as seen in FIG. 4C, and thereby free the mills 204 from engagement with the whipstock 202.

With the shear bolt 208 severed and the weight still applied on the lead mill 206 from the surface location, the lead mill 206 may move in the downhole direction (i.e., to the right in FIG. 4A) and correspondingly force the torque key 402 against the bumper members 224. Moving the torque key 402 in the downhole direction compresses the bumper members 224 and removes the retaining pin 406 from insertion within the pin aperture 408. Once the retaining pin 406 becomes disengaged with the torque key 402, the torque key 402 may then be able to move or otherwise retract to its retracted position, as shown in FIG. 4C.

In some embodiments, an actuation device 414 may be used to move or urge the torque key 402 to the retracted position. In the illustrated embodiment, for instance, the actuation device 414 is depicted as a coil extension spring coupled to both the torque key 402 and an inner surface of the slot 404. Upon releasing the torque key 402 from engagement with the retaining pin 406, the spring force built up in the coil extension spring may urge the torque key 402 to retract vertically into the slot 404. In other embodiments, however, the actuation device 414 may be any device or mechanism that is able to retract the torque key 402 into the slot 404 upon the torque key 402 being disengaged from the retaining pin 406. For instance, the actuation device 414 may alternatively be, but is not limited to, a mechanical actuator, an electromechanical actuator, an electric actuator, a pneumatic actuator, a hydraulic actuator, and any combination thereof, without departing from the scope of the disclosure.

Forcing the lead mill 206 and torque key 402 against the bumper members 224 may cause the bumper members 224 to compress and build an opposing biasing resistance against the torque key 402 in the uphole direction (i.e., to the left in FIG. 3B). The mills 204 (including the lead mill 206) may then be pulled back in the uphole direction a short distance, and the bumper members 224 may be configured to expand into a relaxed state and generally fill the longitudinal groove 222 until engaging the axial end wall 228. With the mills 204 free from the whipstock 202, the mills 204 may then be rotated about the central axis 232 and simultaneously advanced in the downhole direction. As the mills 204 advance in the downhole direction, they ride up the ramped surface 223 of the whipstock 202 until engaging and milling the inner wall of the casing 124 to form the casing exit 132. With the torque key 402 in the retracted position and otherwise retracted into the slot 404, the mills 204 may proceed downhole past the longitudinal groove 222 and the bumper members 224 unobstructed. Moreover, since the torque key 402 is retracted into the slot 404, the mills 204 may proceed without having to mill through the torque key 402. As a result, the torque key 402 may be made of a more robust material, such as stainless steel, alloy steel or any high strength material.

Figure 5A:
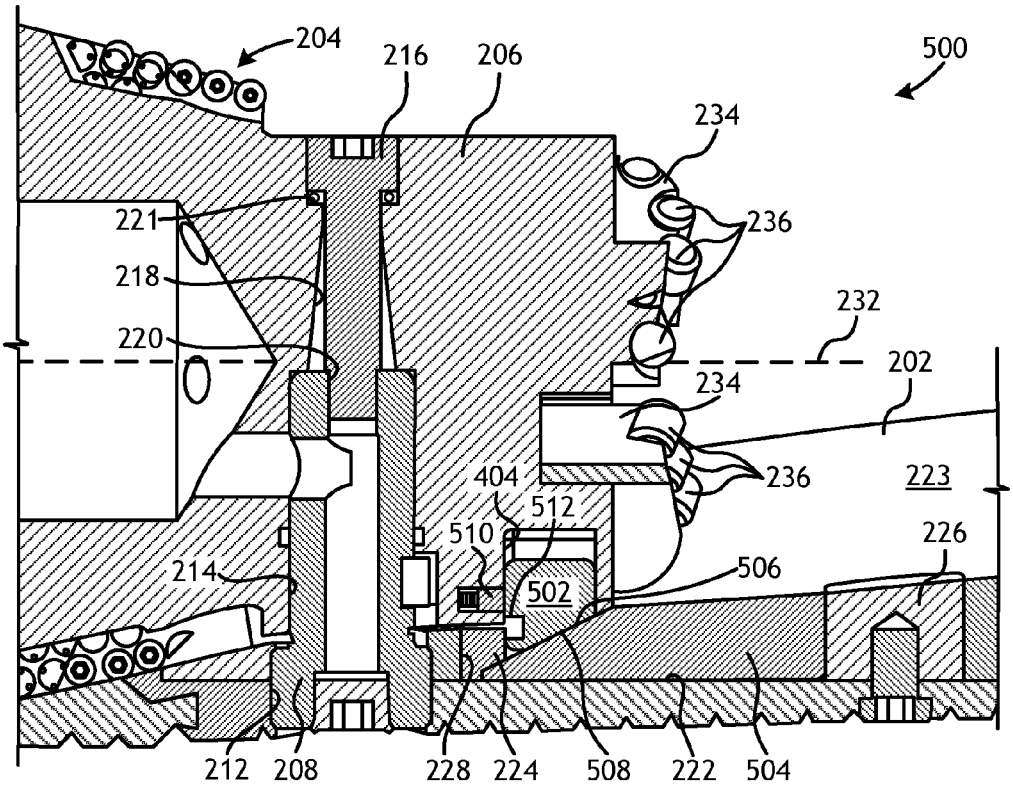
FIGS. 5A-5C are various views of another exemplary whipstock assembly.
Figure 5B:
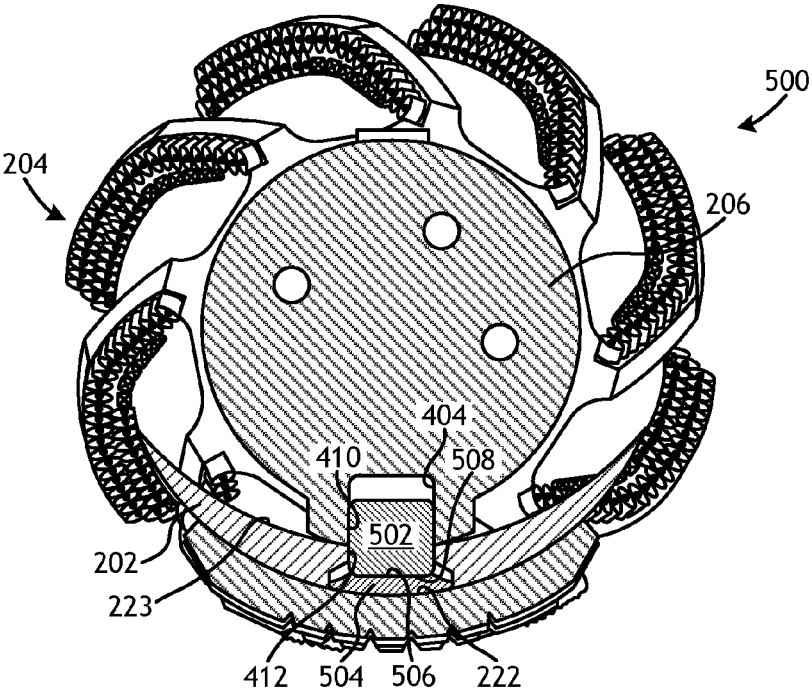
Figure 5C:
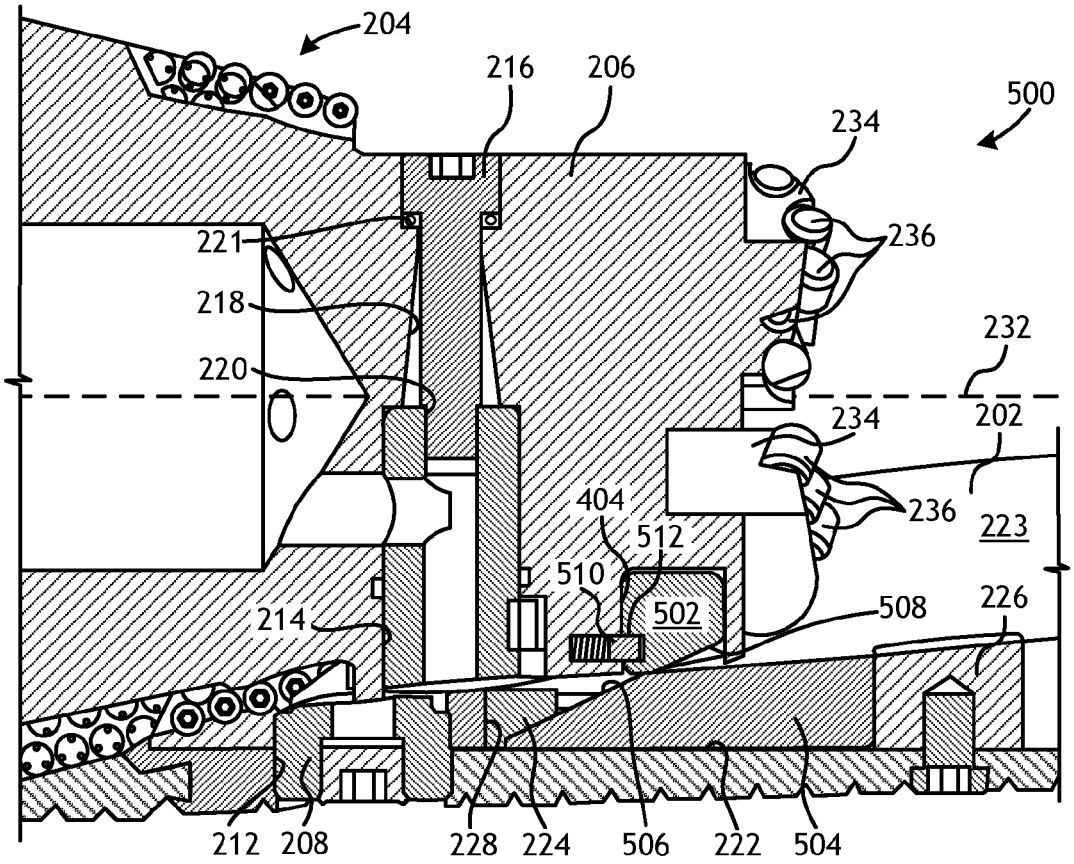

Referring now to FIGS. 5A-5C, illustrated are views of another exemplary whipstock assembly 500, according to one or more additional embodiments of the present disclosure. More particularly, FIG. 5A depicts a cross-sectional side view of the whipstock assembly 500 in an extended configuration, FIG. 5B depicts a cross-sectional end view of the whipstock assembly 500 in the extended configuration, and FIG. 5C depicts a cross-sectional side view of the whipstock assembly 500 in a retracted configuration. The whipstock assembly 500 may be similar in some respects to the whipstock assembly 400 of FIG. 4 and therefore may be best understood with reference thereto, where like numerals indicate like elements or components not described again in detail. Similar to the whipstock assembly 400 of FIG. 4, for example, the whipstock assembly 500 may include the whipstock 202, the mills 204 (including the lead mill 206), the shear bolt 208 used to secure the lead mill 206 to the whipstock 202, the retaining bolt 216 used to secure the shear bolt 208 to the lead mill 206, the blades 234 and the plurality of cutters 236 secured to each blade 234, as generally described above.

Moreover, similar to the torque key 402 of FIGS. 4A-4C, the whipstock assembly 500 may also include a torque key 502 used to help stabilize the lead mill 206 in torque as coupled to the whipstock 202. The torque key 502 may be movably arranged within the slot 404 defined in the lead mill 206 and otherwise movable between a first or extended position, as shown in FIGS. 5A and 5B, to a second or retracted position, as shown in FIG. 5C. In the extended position, the torque key 502 may be partially positioned within both the slot 404 and the longitudinal groove 222 defined in the ramped surface 223 of the whipstock 202. Moreover, in the extended position, the torque key 502 may prevent the lead mill 206 (or the mills 204 generally) from rotating about the central axis 232. More particularly, and as best seen in FIG. 5B, when a torsional load is applied to the lead mill 206, the torque key 502 assumes the torsional load via the slot sidewalls 410 and transfers the torsional load to the groove sidewalls 412. Transferring the torsional load to the groove sidewalls 412 may effectively transfer the torsional load to the whipstock 202 for rotation. Embedding the torque key 502 into the lead mill 206 allows the torque key 502 to operate as soon as a torque load is applied to the lead mill 206, thus minimizing the torsional load on the shear bolt 208.

A wedge support 504 may be positioned within the longitudinal groove 222 and extend axially from the whipstock plate 226 toward the axial end wall 228 of the longitudinal groove 222. In at least one embodiment, one or more bumper members 224 may be arranged between the wedge support 504 and the axial end wall 228. In other embodiments, however, the bumper members 224 may be omitted from the whipstock assembly 500, without departing from the scope of the present disclosure.

As illustrated, the wedge support 504 may provide or otherwise define a wedge angled surface 506 that transitions into the ramped surface 223 of the whipstock 202. As described in greater detail below, the wedge angled surface 506 may slidingly engage a corresponding key angled surface 508 of the torque key 502 in moving the torque key 502 to the retracted position. When the torque key 502 is in the extended position, however, as shown in FIGS. 5A and 5B, the key angled surface 508 may be in contact with the wedge angled surface 506.

The whipstock assembly 500 may further include one or more dogs 510 (one shown) configured to secure the torque key 502 in the retracted position. More particularly, the dog(s) 510 may be spring-loaded and configured to be received within corresponding dog apertures 512 (one shown) defined in the torque key 502 as the torque key 502 moves to the retracted configuration. As illustrated, the dog(s) 510 may be provided on the lead mill 206 and otherwise able to extend axially therefrom upon locating the corresponding dog aperture(s) 512 of the torque key 502.

With continued reference to FIGS. 5A-5C, and reference again to FIG. 1, exemplary operation of the whipstock assembly 500 is now provided. The whipstock assembly 500 may be similar to or the same as the whipstock assembly 130 of FIG. 1 and, therefore, may be able to be lowered into the wellbore 122 and secured therein to help facilitate the creation of the casing exit 132 in the casing 124. As the whipstock assembly 500 is conveyed downhole and latched into the anchor assembly 134, the whipstock 500 assembly may be in the extended configuration where the torque key 502 is in the extended position and the key angled surface 508 of the torque key 502 is in contact with the wedge angled surface 506 of the wedge support 504. Any torsional loads generated while latching in the whipstock assembly 500, or while rotating the whipstock assembly 500 to bypass tight portions of the wellbore 122 (FIG. 1), may be assumed by the torque key 502 through contact between the torque key 502 and the slot and groove sidewalls 410, 412. The torque key 502 transfers the torsional load to the whipstock 202 for intended rotation thereof. Accordingly, the whipstock assembly 500 may allow more torque to be transmitted from the lead mill 206 to the whipstock 202 without shearing or otherwise compromising the structural integrity of the shear bolt 208.

Once the whipstock assembly 500 is properly latched into the anchor assembly 134, weight may be set down on the whipstock assembly 500 from a surface location, which provides an axial load to the lead mill 206 and transfers a predetermined axial load to the shear bolt 208. Upon assuming the predetermined axial load, the shear bolt 208 may shear or otherwise fail, as seen in FIG. 5C, and thereby free the mills 204 from engagement with the whipstock 202.

With the shear bolt 208 severed and the weight still applied on the lead mill 206 from the surface location, the lead mill 206 may move in the downhole direction (i.e., to the right in FIG. 5A) with respect to the whipstock 202. As the lead mill 206 moves in the downhole direction, the key angled surface 508 of the torque key 502 may slidingly engage the wedge angled surface 506 of the wedge support 504, and thereby move or urge the torque key 502 vertically into the slot 404 and otherwise to its retracted position. In the retracted position, the spring-loaded dog(s) 510 may locate the corresponding dog aperture(s) 512 to secure the torque key 502 in the retracted position.

With the mills 204 free from the whipstock 202, the mills 204 (including the lead mill 206) may then be pulled back in the uphole direction a short distance, rotated about the central axis 232, and simultaneously advanced in the downhole direction. As the mills 204 advance in the downhole direction, they ride up the ramped surface 223 of the whipstock 202 until engaging and milling the inner wall of the casing 124 to form the casing exit 132. With the torque key 502 in the retracted position and otherwise retracted into the slot 404, the mills 204 may proceed downhole past the longitudinal groove 222 unobstructed. Moreover, since the torque key 502 is retracted into the slot 404, the mills 204 may proceed without having to mill through the torque key 502. As a result, the torque key 502 may be made of a more robust material, such as stainless steel, alloy steel or any high strength material.

Embodiments disclosed herein include:

A. A whipstock assembly that includes a whipstock providing a ramped surface and a longitudinal groove defined in the ramped surface, a lead mill coupled to the whipstock with a shear bolt and providing one or more blades, and a bearing support arranged within the longitudinal groove and providing opposing sidewalls that define a slot configured to receive one of the one or more blades and thereby prevent the lead mill from rotating with respect to the whipstock.

B. A well system that includes an anchor assembly arranged within a wellbore, a whipstock assembly extendable within the wellbore to be secured to the anchor assembly, the whipstock assembly including a whipstock that provides a ramped surface and a longitudinal groove defined in the ramped surface, and a lead mill coupled to the whipstock with a shear bolt and providing one or more blades, and a bearing support arranged within the longitudinal groove and providing opposing sidewalls that define a slot configured to receive one of the one or more blades and thereby prevent the lead mill from rotating with respect to the whipstock.

C. A method that includes extending a whipstock assembly into a wellbore, the whipstock assembly including a whipstock that provides a ramped surface and a longitudinal groove defined in the ramped surface, and a lead mill coupled to the whipstock with a shear bolt and providing one or more blades, applying a torsional load to the whipstock assembly, assuming the torsional load with a bearing support arranged within the longitudinal groove and providing opposing sidewalls that define a slot configured to receive one of the one or more blades, and preventing the lead mill from rotating with respect to the whipstock with the bearing support.

Each of embodiments A, B, and C may have one or more of the following additional elements in any combination: Element 1: wherein the bearing support comprises a material selected from the group consisting of aluminum, bronze, cast steel, mild steel, free machining steel, fiberglass, any derivative thereof, and any combination thereof. Element 2: wherein the opposing sidewalls extend upwardly out of the longitudinal groove and transition into opposing side extensions that rest on the ramped surface and extend in opposing directions away from the slot. Element 3: further comprising one or more bumper members arranged within the longitudinal groove and biasing the bearing support against an axial end wall of the longitudinal groove, and a whipstock plate arranged in the longitudinal groove and supporting the one or more bumper members in engagement with the bearing support. Element 4: wherein the one or more bumper members are made of rubber or an elastomer. Element 5: further comprising a slot bumper arranged within the slot to vertically support the one of the one or more blades. Element 6: wherein the slot bumper is made of rubber or an elastomer.

Element 7: wherein the bearing support comprises a material selected from the group consisting of aluminum, bronze, cast steel, mild steel, free machining steel, fiberglass, any derivative thereof, and any combination thereof. Element 8: wherein the opposing sidewalls extend upwardly out of the longitudinal groove and transition into opposing side extensions that rest on the ramped surface and extend in opposing directions away from the slot. Element 9: further comprising one or more bumper members arranged within the longitudinal groove and biasing the bearing support against an axial end wall of the longitudinal groove, and a whipstock plate arranged in the longitudinal groove and supporting the one or more bumper members in engagement with the bearing support. Element 10: wherein the one or more bumper members are made of rubber or an elastomer. Element 11: further comprising a slot bumper arranged within the slot to vertically support the one of the one or more blades.

Element 12: wherein applying the torsional load to the whipstock assembly comprises rotating the whipstock assembly to latch into an anchor assembly arranged in the wellbore. Element 13: wherein applying the torsional load to the whipstock assembly comprises rotating the whipstock assembly to bypass a portion of the wellbore. Element 14: wherein assuming the torsional load with the bearing support comprises engaging the one of the one or more blades on at least one of the opposing sidewalls, and transferring the torsional load from the bearing support to the whipstock. Element 15: further comprising latching the whipstock assembly into an anchor assembly arranged in the wellbore, providing an axial load to the lead mill and shearing the shear bolt upon assuming a predetermined axial load, forcing the bearing support out of engagement with an axial end wall of the longitudinal groove and against one or more bumper members arranged within the longitudinal groove, removing the axial load on the lead mill, and urging the bearing support back against the axial end wall of the longitudinal groove with the one or more bumper members. Element 16: wherein the opposing sidewalls extend upwardly out of the longitudinal groove and transition into opposing side extensions that rest on the ramped surface and extend in opposing directions away from the slot, the method further comprising rotating the lead mill about a central axis, advancing the lead mill within the wellbore and thereby riding up the ramped surface of the whipstock, and milling at least a portion of the bearing support with the lead mill as the lead mill advances up the ramped surface, wherein the side extensions of the bearing support comprises a material selected from the group consisting of aluminum, bronze, cast steel, mild steel, free machining steel, fiberglass, any derivative thereof, and any combination thereof. Element 17: wherein a slot bumper is arranged within the slot, the method further comprising vertically supporting the one of the one or more blades with the slot bumper.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A whipstock assembly, comprising:

a whipstock providing a ramped surface and a longitudinal groove defined in the ramped surface;

a lead mill coupled to the whipstock with a shear bolt and providing one or more blades; and a bearing support arranged within the longitudinal groove and providing opposing sidewalls that define a slot configured to receive one of the one or more blades and thereby prevent the lead mill from rotating with respect to the whipstock.

2. The whipstock assembly of claim 1, wherein the bearing support comprises a material selected from the group consisting of aluminum, bronze, cast steel, mild steel, free machining steel, fiberglass, any derivative thereof, and any combination thereof.

3. The whipstock assembly of claim 1, wherein the opposing sidewalls extend upwardly out of the longitudinal groove and transition into opposing side extensions that rest on the ramped surface and extend in opposing directions away from the slot.

4. The whipstock assembly of claim 1, further comprising:

one or more bumper members arranged within the longitudinal groove and biasing the bearing support against an axial end wall of the longitudinal groove; and a whipstock plate arranged in the longitudinal groove and supporting the one or more bumper members in engagement with the bearing support.

5. The whipstock assembly of claim 4, wherein the one or more bumper members are made of rubber or an elastomer.

6. The whipstock assembly of claim 1, further comprising a slot bumper arranged within the slot to vertically support the one of the one or more blades.

7. The whipstock assembly of claim 6, wherein the slot bumper is made of rubber or an elastomer.

8. A well system, comprising:

an anchor assembly arranged within a wellbore;

a whipstock assembly extendable within the wellbore to be secured to the anchor assembly, the whipstock assembly including a whipstock that provides a ramped surface and a longitudinal groove defined in the ramped surface, and a lead mill coupled to the whipstock with a shear bolt and providing one or more blades; and a bearing support arranged within the longitudinal groove and providing opposing sidewalls that define a slot configured to receive one of the one or more blades and thereby prevent the lead mill from rotating with respect to the whipstock.

9. The well system of claim 8, wherein the bearing support comprises a material selected from the group consisting of aluminum, bronze, cast steel, mild steel, free machining steel, fiberglass, any derivative thereof, and any combination thereof.

10. The well system of claim 8, wherein the opposing sidewalls extend upwardly out of the longitudinal groove and transition into opposing side extensions that rest on the ramped surface and extend in opposing directions away from the slot.

11. The well system of claim 8, further comprising:

one or more bumper members arranged within the longitudinal groove and biasing the bearing support against an axial end wall of the longitudinal groove; and a whipstock plate arranged in the longitudinal groove and supporting the one or more bumper members in engagement with the bearing support.

12. The well system of claim 11, wherein the one or more bumper members are made of rubber or an elastomer.

13. The well system of claim 8, further comprising a slot bumper arranged within the slot to vertically support the one of the one or more blades.

14. A method, comprising:

extending a whipstock assembly into a wellbore, the whipstock assembly including a whipstock that provides a ramped surface and a longitudinal groove defined in the ramped surface, and a lead mill coupled to the whipstock with a shear bolt and providing one or more blades;

applying a torsional load to the whipstock assembly;

assuming the torsional load with a bearing support arranged within the longitudinal groove and providing opposing sidewalls that define a slot configured to receive one of the one or more blades; and preventing the lead mill from rotating with respect to the whipstock with the bearing support.

15. The method of claim 14, wherein applying the torsional load to the whipstock assembly comprises rotating the whipstock assembly to latch into an anchor assembly arranged in the wellbore.

16. The method of claim 14, wherein applying the torsional load to the whipstock assembly comprises rotating the whipstock assembly to bypass a portion of the wellbore.

17. The method of claim 14, wherein assuming the torsional load with the bearing support comprises:

engaging the one of the one or more blades on at least one of the opposing sidewalls; and transferring the torsional load from the bearing support to the whipstock.

18. The method of claim 14, further comprising:

latching the whipstock assembly into an anchor assembly arranged in the wellbore;

providing an axial load to the lead mill and shearing the shear bolt upon assuming a predetermined axial load;

forcing the bearing support out of engagement with an axial end wall of the longitudinal groove and against one or more bumper members arranged within the longitudinal groove;

removing the axial load on the lead mill; and urging the bearing support back against the axial end wall of the longitudinal groove with the one or more bumper members.

19. The method of claim 18, wherein the opposing sidewalls extend upwardly out of the longitudinal groove and transition into opposing side extensions that rest on the ramped surface and extend in opposing directions away from the slot, the method further comprising:

rotating the lead mill about a central axis;

advancing the lead mill within the wellbore and thereby riding up the ramped surface of the whipstock; and milling at least a portion of the bearing support with the lead mill as the lead mill advances up the ramped surface, wherein the side extensions of the bearing support comprises a material selected from the group consisting of aluminum, bronze, cast steel, mild steel, free machining steel, fiberglass, any derivative thereof, and any combination thereof.

20. The method of claim 14, wherein a slot bumper is arranged within the slot, the method further comprising vertically supporting the one of the one or more blades with the slot bumper.

* * * * *